US006709017B2

(12) United States Patent
Ross

(10) Patent No.: US 6,709,017 B2
(45) Date of Patent: Mar. 23, 2004

(54) INDICIA FOR CONTAINERS

(75) Inventor: Michael Edward Ross, Oxford, CT (US)

(73) Assignee: Unilever Home & Personal Care USA division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/474,160

(22) Filed: Dec. 29, 1999

(65) Prior Publication Data

US 2003/0006605 A1 Jan. 9, 2003

(51) Int. Cl.[7] ..... B42D 15/00

(52) U.S. Cl. ..... 283/81; 283/109; 283/79; 40/310

(58) Field of Search ..... 283/81, 94, 91, 283/101, 105, 56, 79, 80, 107, 109, 110, 111; 40/310; 220/450; 428/35; 215/365

(56) References Cited

U.S. PATENT DOCUMENTS 3,955,020 A * 5/1976 Cavanagh et al. ..... 428/35
4,159,586 A 7/1979 Blum
4,659,111 A * 4/1987 Credit ..... 283/81
4,662,528 A * 5/1987 Slat ..... 220/450
4,763,930 A * 8/1988 Matney ..... 283/81
4,884,827 A * 12/1989 Kelley ..... 283/81
4,887,845 A 12/1989 Nagai
5,123,745 A * 6/1992 Augur ..... 40/310
5,366,251 A 11/1994 Brandt et al.
5,642,906 A 7/1997 Foote et al.
5,758,440 A * 6/1998 Yudin ..... 40/310
5,773,112 A * 6/1998 Tachikawa et al. ..... 283/81 X
5,855,083 A 1/1999 Bilbie et al.
6,073,373 A * 6/2000 Haugk et al. ..... 40/310

FOREIGN PATENT DOCUMENTS

EP 0 559 440 A1 9/1993

* cited by examiner

*Primary Examiner*—Willmon Fridie, Jr.
(74) *Attorney, Agent, or Firm*—Alan A. Bornstein

(57) ABSTRACT

A container having an outer removable overlying label which covers an underlying permanently affixed label. The outer label is at least partially translucent, or preferably transparent. Use of a removable outer label permits the consumer to remove some or all of the verbiage which is important for the label, but which need not be present on the container in use in the consumer's home. In an alternative embodiment, the outer label is removably affixed to a wall of the container.

7 Claims, 2 Drawing Sheets

INDICIA FOR CONTAINERS

BACKGROUND OF THE INVENTION

In the intensely competitive markets for consumer goods, manufacturers attempt to capture the long term attention of consumers with their improved products. However, initially the consumer's attention must be attracted through advertising and/or product labeling. Often there is a need to communicate to the consumer several messages concerning the product. Therefore, the labels can become somewhat "busy."

A goal which is sometimes in conflict with the need to impart extensive information through labeling is to provide the consumer with an attractive product, particularly an attractive package for use in the home. Much effort has been expended in recent years in designing packaging having a pleasing appearance. However, the favorable esthetic effect of the package can be diminished by labels brimming with verbiage.

It is known to adhere permanently one ply to another. One of the plies may be a label. This is generally done for protection purposes.

It is known to adhere removably an opaque pressure sensitive label to a bottom ply. This has been done primarily to permit the consumer to remove the top label as a coupon, thereby leaving the bottom label intact.

A product sold under the name "Herbal Essence" by Clairol in a 24 oz. container used a two-ply structure wherein both plies were clear, but wherein the plies were adhered using a varnish.

SUMMARY OF THE INVENTION

It has been discovered that the conflict between providing informative label graphics, on the one hand, and providing the consumer with an attractive package for use in the home on the other can be resolved by use of a package having a removable label, preferably one which is at least partially transparent. Much or all of the indicia for attracting the attention of the consumer to the product can be displayed on the label, which may be removed after purchase. Underneath the label may be either a wall of the container or a second ply having label information, an attractive design, or nothing. In a particularly preferred feature of the invention, the underlying package wall or underlying second ply contains indicia which can be seen through the first ply, thereby complementing the indicia on the top label.

One and/or both plies can be made of polypropylene. Preferably the top label is adhered to the second ply or to the container wall with a reworkable pressure sensitive adhesive such as an acrylic adhesive. In accordance with the invention, the top (or only) ply can readily be removed by the consumer with application of only modest force.

The container of the invention may be used for various household products, including personal washing products such as liquid and semi-liquid washing products, soap bars and non-soap surfactant bars, laundry products such as detergents and fabric softeners and foods such as liquid and plastic margarines and other spreads. The container is preferably in the form of a thermoplastic bottle but may also be a carton or other container.

For a more complete understanding of the above and other features and advantages of the invention, reference should be made to the detailed description of preferred embodiments and to the accompanying drawings.

DETAILED DESCRIPTION OF THE INVENTION

Figure 1:
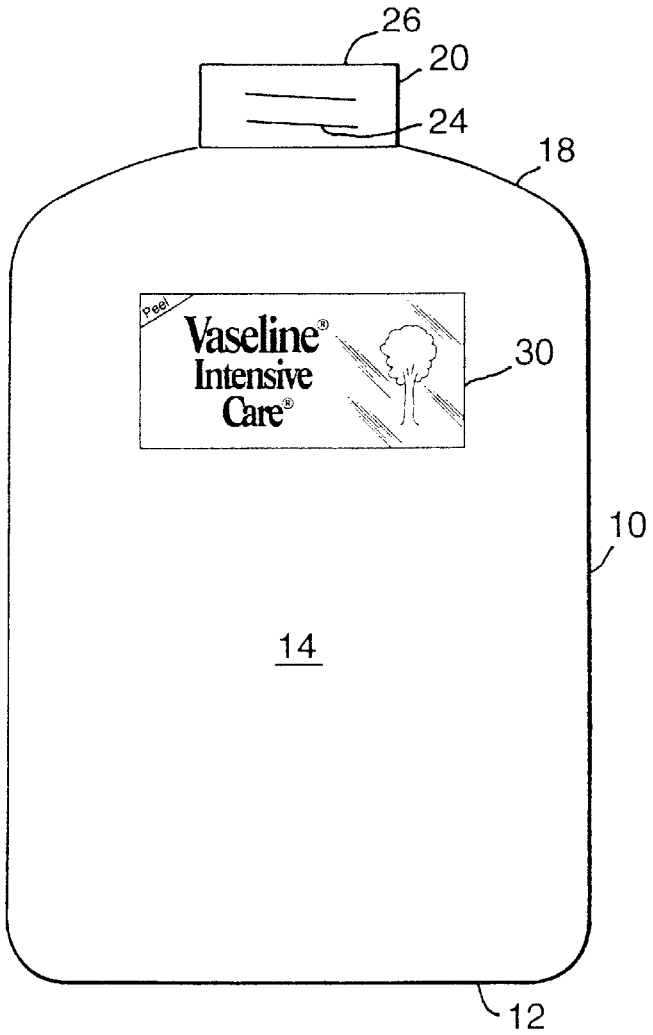
FIG. 1 is a front elevational view of a bottle according to the invention.
Figure 2:
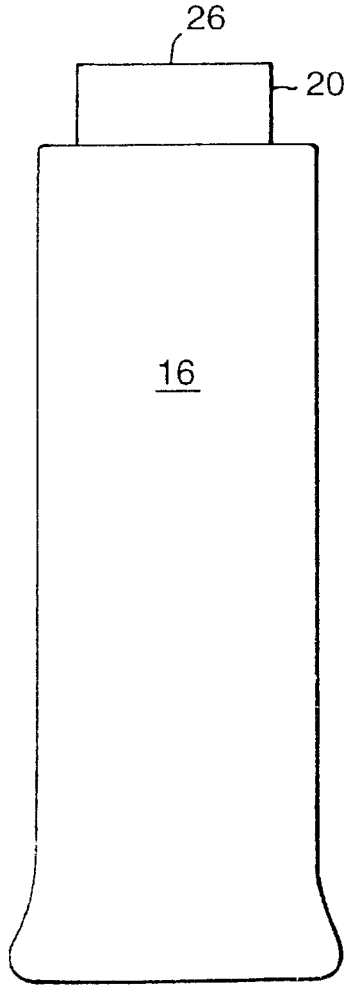
FIG. 2 is a side elevational view of the bottle of FIG. 1.

Bottle 10 includes a base 12, front wall 14, side wall 16, and a shoulder 18 leading to finish 20 having external threads 24 for mating with internal threads on a closure (not shown). Bottle 10 further includes an opening 26 at its top for dispensing product. Additional features may optionally be present such as a drainback fitment or a pumping mechanism.

In accordance with the present invention, bottle 10 includes labeling composite 30. Labeling composite 30 includes two plies, a first or front ply 32 and second ply 34. Ply 32 is removably adhered to ply 34 by a reworkable pressure sensitive adhesive 36 which may be acrylic.

Figure 3:
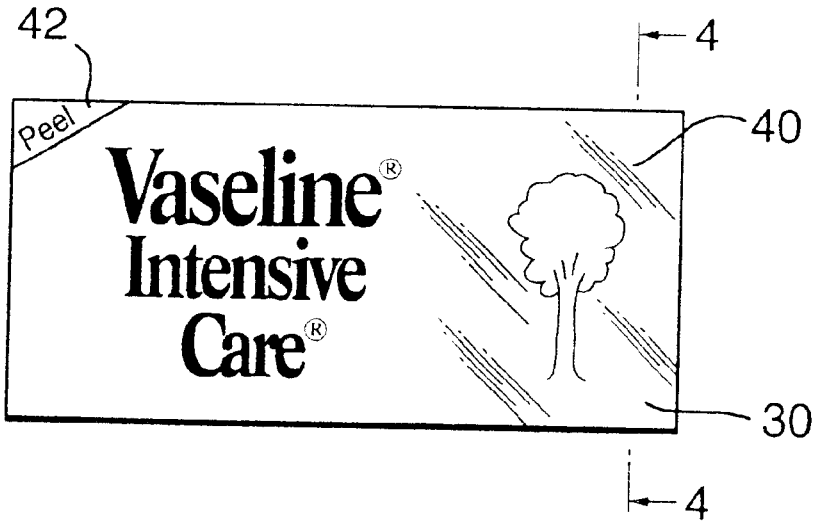
FIG. 3 is a top plan view of a label according to the invention.
Figure 4:
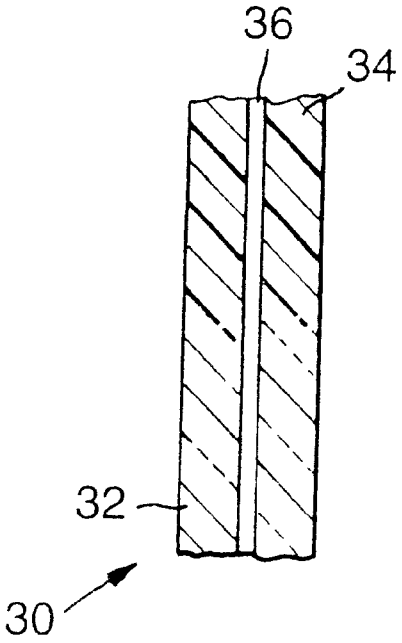
FIG. 4 is a cross section along the lines of 4—4 of FIG. 3.

It is especially preferred that a portion of at least the outer ply 32 is translucent, and more preferably transparent. It is, thus, desirable that at least a portion of underlying label 34 can be seen through upper label 32. For instance, in FIG. 3, it is possible to see the illustration 40 of a tree disposed on lower label 34 through transparent portions of upper label 32. This provides an interesting multi-dimensional effect for the consumer. Moreover, the word-intensive upper label 32 may be removed by the consumer easily by grasping label 32 at corner 42 and peeling it away from underlying ply 34. As a result, the package which the consumer leaves in his or her bathroom, kitchen or other room, may include only a pleasant graphic design instead of the extensive verbiage which may be required on the outer label.

Underlying ply 34 is preferably adhered to bottle wall 14 with a permanent acrylic adhesive.

The following tables set forth the preferred and most preferred amounts of force needed to remove the removable and permanent labels using protocol PSTC 1 modified for 72 hour dwell time.

Removable label adhered to:

| | Most Preferred | Preferred |
|---|---|---|
| Stainless Steel: | 19 oz/in avg. | Range: 8–35 oz/in. |
| Acrylic: | 17 oz/in avg. | Range: 8–35 oz/in. |
| Glass: | 15 oz/in avg. | Range: 8–35 oz/in. |

Permanent label adhered to:

| | Most Preferred | Preferred |
|---|---|---|
| Stainless Steel: | 62 oz/in avg. | Range: 50–75 oz/in. |
| Acrylic: | 74 oz/in avg. | Range: 60–85 oz/in. |
| Glass: | 61 oz/in avg. | Range: 50–75 oz/in. |
| Polypropylene | 46 oz/in avg. | Range: 35–60 oz/in. |

In a preferred embodiment, the graphics on the front label and on the graphics on the top label and on the underlying label complement each other. For instance, graphics on the upper label may form one part of the scene and graphics on the lower label may form a second part of the scene. However removal of the upper label will still leave the lower label with sufficient graphics to contribute to the attractive appearance of the container.

Figure 5:
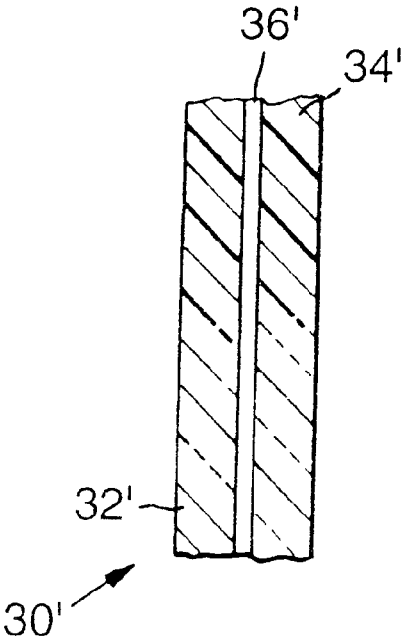
FIG. 5 is a view similar to FIG. 4 but showing an alternate embodiment.

While it is desirable that upper ply 32 is at least partially translucent, preferably transparent, it may also be desirable that underlying ply 34 be partially translucent or transparent to provide a desirable appearance for the package. As seen in FIG. 5, in accordance with an alternate embodiment of the invention, label structure 30' comprises label 32' removably adhered by acrylic adhesive 36' to bottle wall 34'. Bottle wall 34' may, for instance, have indicia for making the container more attractive or may lack any indicia whatsoever. In this embodiment it is preferred that label 32' is at least partially translucent, preferably transparent, although it may be opaque.

Container 10 may be fabricated by any of many well known fabrication techniques including extrusion blow molding, injection blow molding and injection stretch blow molding 1 or 2 stage. It may be may be made of any of numerous materials, preferably thermoplastic materials such as polyethylene (HDPE, MDPE, LDPE, LLDPE), polypropylene (PP, OPP), polyvinyl chloride (PVC), polyethylene terephthalate (EPET, PETG, OPET) and polystyrene (PS, HIPS). Other materials from which the plies may be made include polyethylene (HDPE, MDPE, LDPE, LLDPE), polypropylene (PP, OPP), polyvinyl chloride (PVC), polyethylene terephthalate (EPET, PETG, OPET) and polystyrene (PS, HIPS). Other potentially suitable adhesive materials include acrylic based adhesives and rubber based adhesives.

It should be understood, of course, that the specific forms of the invention herein illustrated and described are intended to be representative only as certain changes may be made therein without departing from the clear teachings of the disclosure. Accordingly, reference should be made to the appended claims in determining the full scope of the invention.

I claim:

1. A package comprising:

a) a chamber defined by at least one wall, b) a first ply secured to said wall;

c) a second ply removably affixed to said first ply, said second ply being partially translucent so that a portion of said first ply is visible underneath said second ply; wherein said first ply and said second ply contain graphics which complement each other, wherein said first ply contains graphics which form a first part of a scene and said second ply contains graphics which form a second part of said scene; and d) wherein said first ply remains intact when said second ply is removed.

2. The package according to claim 1 wherein said second ply is partially transparent.

3. The package according to claim 1 wherein said first ply is affixed to said wall with a permanent pressure sensitive acrylic adhesive.

4. The package according to claim 1 wherein second ply is affixed to said first ply with a reworkable pressure sensitive acrylic adhesive.

5. The package according to claim 1 wherein said second ply is partially translucent.

6. The package according to claim 1 wherein first ply comprises polypropylene.

7. The package according to claim 1 wherein said second ply comprises polypropylene.

* * * * *